United States Patent [19]

Anderle

[11] 4,309,858

[45] Jan. 12, 1982

[54] SUPPORT FOR CEILING PANELS

[75] Inventor: Joseph A. Anderle, Clifton, N.J.

[73] Assignee: Levolor Lorentzen, Inc., Lyndhurst, N.J.

[21] Appl. No.: 101,241

[22] Filed: Dec. 7, 1979

[51] Int. Cl.[3] ..... E04B 5/57

[52] U.S. Cl. ..... 52/632; 52/489; 52/645

[58] Field of Search ..... 52/818, 473, 75, 817, 52/820, 762, 489, 484, 76, 77, 78, 645, 632

[56] References Cited

U.S. PATENT DOCUMENTS

| | | | |
|---|---|---|---|
| 2,560,248 | 7/1951 | Riemann | 52/76 |
| 2,586,337 | 2/1952 | Hughes | 52/77 |
| 2,613,404 | 10/1952 | Jones | 52/77 |
| 2,670,919 | 3/1954 | Esoldi | 52/632 |
| 2,736,932 | 3/1956 | Ray | 52/78 |
| 3,182,773 | 5/1965 | Laaksonen | 52/762 |
| 3,277,622 | 10/1966 | Jensen | 52/489 |
| 3,589,086 | 6/1971 | Schilling | 52/632 |
| 3,678,641 | 7/1972 | Englund | 52/484 |

FOREIGN PATENT DOCUMENTS

| | | | |
|---|---|---|---|
| 1327617 | 4/1963 | France | 52/489 |
| 1490733 | 6/1967 | France | 52/489 |

*Primary Examiner*—John E. Murtagh

[57] ABSTRACT

A support for supporting ceiling panels in a space having two non-parallel walls, including at least two channels arranged parallel to and spaced from each other, at least two telescopic channels respectively received in the two channels in a plurality of positions to vary the length thereof between the two non-parallel walls, and at least two panel holders supported on the two telescopic channels. The position of the respective panel holder may be varied along the telescopic channel so that ceiling panels may be suspended therefrom so that the space between the non-parallel walls can be essentially evenly divided by the appropriate distribution of the ceiling panels to thereby reduce the appearance of non-parallelity of the walls and ceiling panels.

9 Claims, 6 Drawing Figures

SUPPORT FOR CEILING PANELS

BACKGROUND OF THE INVENTION

The present invention relates to a ceiling or similar structure, and more specifically relates to a support for ceiling panels. There are situations where the geometry of a room is such that the parallel panels of a suspended ceiling will produce an undesirable rectangular gap or even more objectionable, a trapezoidal gap which will accentuate the appearance of walls that are not parallel to each other. Various methods have been used to eliminate the above-mentioned disadvantages. They usually involve increasing the spaces between the last few panels closest to a wall to eliminate the large gap, without optically disturbing the parallel appearance of the panels.

BRIEF SUMMARY OF THE INVENTION

The support for ceiling panels according to the invention comprises in addition to the customary substantially parallel carrier channels with the customary means for receiving ceiling panels, at least two telescopic carrier channels respectively received in and connected to the carrier channels; and a series of individual panel holders adapted to be placed in various positions on the telescopic carrier channels. In this way, a trapezoidal space can be filled with panels by substantially evenly spreading the panels over this space.

BRIEF DESCRIPTION OF THE DRAWINGS

The invention is illustrated, by way of example, in the accompanying drawings, in which.

DETAILED DESCRIPTION OF A PREFERRED EMBODIMENT

Figure 1:
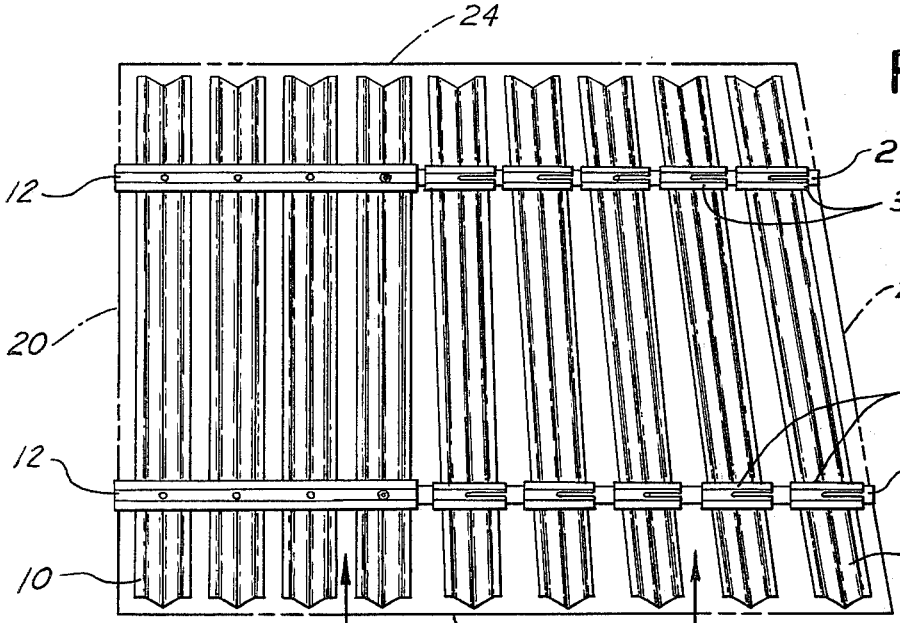
FIG. 1 is a top view of a ceiling with ceiling panels, and supports therefor, in accordance with the present invention.
Figure 2:
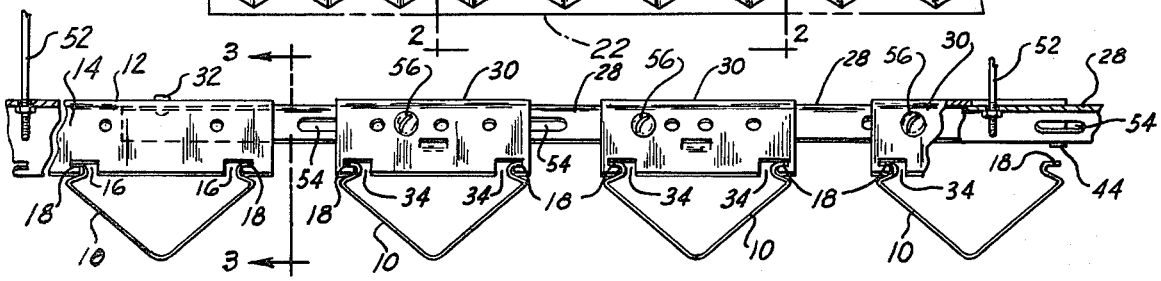
FIG. 2 is a side view as seen from line 2—2 of FIG. 1.
Figure 3:
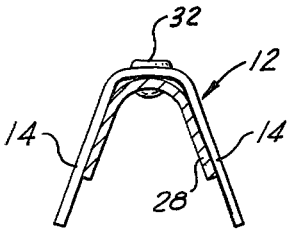
FIG. 3 is a section taken along the line 3—3 of FIG. 2.

The ceiling illustrated in FIG. 1 comprises a number of ceiling panels 10. Some of the panels 10, shown in the lefthand portion of FIG. 1, are supported from carrier channels 12 which are well known in the art. Each channel 12 comprises a substantially V-shaped body 14 with pairs of slot-like openings 16 for receiving therein leg portions 18 of a respective panel 10. Carrier channels 12 are used adjacent the wall 20 which is perpendicular to opposite parallel side walls 22 and 24. On the side opposite wall 20, where the wall 26 is not perpendicular to side walls 22 and 24, the panels 10 are supported by a combination of telescopic carrier channels 28 and individual panel holders 30. The telescopic channel 28 is received within the carrier channel 12 and is connected thereto by one or more rivets 32. Each panel holder 30 has slots 34 similar to slots 16 in carrier channel 12 for receiving portions 18 of panels 10. However, in contrast to the channel 12, each holder 30 has slots 34 on one side portion 31 only and not on the other side portion 33 so that a panel 10 can be arranged at any desired angle with respect to holder 30.

Figure 4:
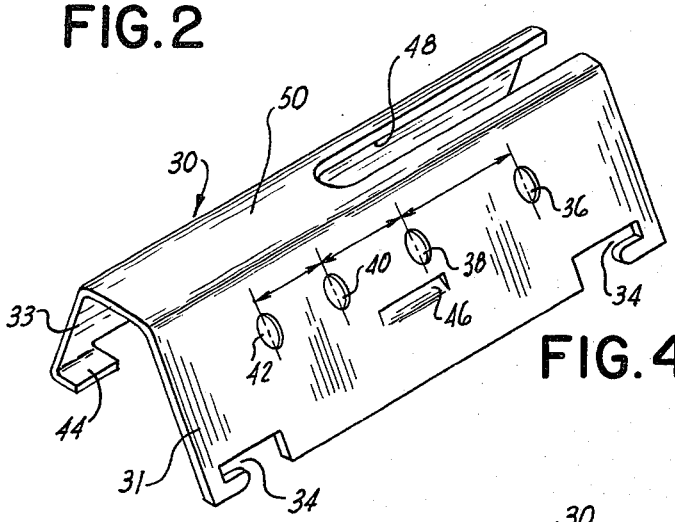
FIG. 4 shows an individual panel support of FIG. 3 in perspective.

One of the side portions, 31, of holder 30 is also provided with a plurality of bores 36, 38, 40 and 42 which are spaced from each other at varying distances for a purpose to be explained later. Such bores may also be provided on the opposite side portion 33. Moreover, each panel holder 30 has toes 44 at opposite ends on side portion 31 (only one toe being shown in FIG. 4) approximately opposite slots 34. It also has an indented portion 46 in side portion 31 and a longitudinal slot 48 in its top wall 50 adjacent one of its ends.

Figure 5:
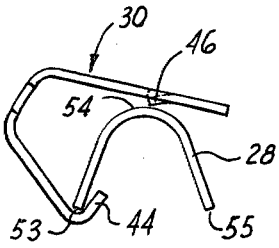
FIGS. 5 and 6 illustrate the method of connecting the individual panel supports to a telescopic panel carrier.
Figure 6:
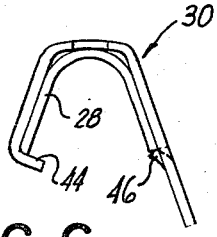

The carrier channels 12 and the telescopic channels 28 are suspended from a suitable support, by means of cables, or rods 52 or the like which pass through corresponding openings in the carrier channels 12 and 28 and opening 48 in some of the panel holders 30. When assembling the suspended ceiling, first the carrier channels 12 are installed with space for a few panels at the end nearest to the non-parallel wall 26. A telescopic channel 28 is attached, with one or more rivets 32, to a respective carrier channel 12. Thereafter, the wires, or rods 52 are adjusted for proper length to level the assembly. In order to connect the panel holders 30 to the appropriate telescopic channel 28, as shown in FIGS. 5 and 6, the panel holder 30 is tipped so that the toes 44 will hook under one edge 53 of the telescopic channel 28. The holder is swung over the top 54 of the channel 28 and pressed downwards until it snaps into place at portion 46 which then holds onto edge 55. The appropriate number of panel holders is thus attached to the telescopic channel 28.

The panels 10 are then assembled to channel 12 to align these channels, especially if more than two are required. The panels are also assembled to the panel holders 30 and shifted to equalize the spaces between the panels and to position the last panel parallel or approximately parallel to wall 26. Finally, if desired the holders 30 are fixed in place by passing a screw 56 through the hole 36 (or 38, 40 or 42) which is in alignment with one of the oblong holes 54 in channel 28. The panels are removed in order to drive the screws 56 through the panel holders.

What is claimed is:

1. A support for supporting ceiling panels in a space having two non-parallel walls, comprising:

at least two channel means arranged essentially parallel to and spaced from each other and having means for supporting at least one ceiling panel therefrom essentially perpendicular to said channel means;

at least two telescopic channel means respectively received within said two channel means in a plurality of positions to vary the length thereof between said two non-parallel walls;

and at least two panel holders respectively supported on said two telescopic channel means, each panel holder having means for supporting a ceiling panel therefrom and being movable on the respective telescopic channel means, whereby the position of the respective panel holder may be varied along said telescopic channel means so that at least another ceiling panel may be arranged between said at least one ceiling panel and one of said two non-parallel walls so as to essentially evenly divide the space therebetween to reduce the appearance of the non-parallelity of the walls and ceiling panels.

2. A support according to claim 1, including means for connecting said telescopic channel means to said channel means in one of said positions.

3. A support according to claim 1, including means for connecting said panel holders to said telescopic channel means.

4. A support according to claim 1, wherein channel means and said telescopic channel means have a substantially V-shaped cross-section.

5. A support according to claim 1, wherein said telescopic channel means has a plurality of oblong holes arranged serially along said channel means.

6. A support according to claim 4, wherein each panel holder has a substantially V-shaped cross-section with an inside surface essentially fitting the outside surface of said telescopic channel means.

7. A support according to claim 1, wherein each panel holder has a top portion and two side portions inclined with respect to said top portion, a toe portion connected to one of said side portions and adapted to engage a first portion of said telescopic channel means, the other side portion having an indentation adapted to engage a second portion of said telescopic channel means to thereby hold said panel holder to said telescopic channel means.

8. A support according to claim 7, wherein said panel holder has a plurality of bores through at least one of said side portions and wherein said telescopic channel means has a plurality of oblong holes arranged serially in said telescopic channel means, and connecting means extending through at least one of said bores and at least one of said plurality of oblong holes in alignment with said one bore to thereby fix said holder to said telescopic channel means.

9. A support according to claim 7, wherein said top portion of said panel holder has a slot, and wherein said telescopic channel means has a bore in alignment with said slot for passing therethrough means for suspending said telescopic channel means from a support.

* * * * *